US005694730A

United States Patent [19]

Del Rincon et al.

[11] Patent Number: 5,694,730

[45] Date of Patent: Dec. 9, 1997

[54] SPLINE FOR JOINING BOARDS

[75] Inventors: Eduardo Del Rincon, Pierrefonds; Alexandre Polisois, Boisbrand, both of Canada

[73] Assignee: Noranda Inc., Toronto, Canada

[21] Appl. No.: 736,961

[22] Filed: Oct. 25, 1996

[51] Int. Cl.[6] ..... E04B 1/38; F16B 13/00

[52] U.S. Cl. ..... 52/586.1; 52/698; 52/586.2; 52/302.1; 52/396.05; 403/298

[58] Field of Search ..... 52/586.1, 586.2, 52/582.1, 704, 712, 396.05, 396.1, 302.1, 302.3, 394, 468, 698; 403/298, 294, 292, 405.1; 411/458, 460, 921, 439

[56] References Cited

U.S. PATENT DOCUMENTS

| | | | |
|---|---|---|---|
| 1,018,987 | 2/1912 | Philpot . | |
| 1,723,306 | 8/1929 | Sipe . | |
| 3,507,083 | 4/1970 | Fish, Jr. et al. . | |
| 3,563,582 | 2/1971 | Shroyer et al. . | |
| 3,662,805 | 5/1972 | Sygnator . | |
| 3,874,142 | 4/1975 | Dallen . | |
| 3,875,719 | 4/1975 | Menge . | |
| 4,157,271 | 6/1979 | Moore . | |
| 4,599,841 | 7/1986 | Haid | 52/586.2 X |
| 4,833,858 | 5/1989 | Hutchison . | |
| 5,182,892 | 2/1993 | Chase . | |
| 5,263,294 | 11/1993 | Koenig et al. | 52/468 |
| 5,297,892 | 3/1994 | Preziosa . | |
| 5,433,806 | 7/1995 | Pasquali et al. . | |
| 5,438,809 | 8/1995 | Ehrlich . | |

FOREIGN PATENT DOCUMENTS 9533898 12/1995 WIPO .

*Primary Examiner*—Robert Canfield

*Attorney, Agent, or Firm*—Fitzpatrick, Cella, Harper & Scinto

[57] ABSTRACT

A spline for joining wood boards or panels with a groove extending throughout their longitudinal sections. The spline has a body with an upper surface and a lower surface, and central concave ridges on the at least one of upper and lower surfaces for draining water. The ridge extends throughout the length of the spline so that when two adjacent boards or panels are joined by the spline, the space between the boards or panels or equal to the width of the ridge. The spline has been designed to provided efficient drainage of water, thus preventing and substantially limiting swelling, if any, of the boards. The spline of the present invention provides a joint with mechanical and resistance properties comparable to conventional tongue and groove boards.

10 Claims, 3 Drawing Sheets

SPLINE FOR JOINING BOARDS

FIELD OF THE INVENTION

The present invention is concerned with a novel spline for joining boards. The spline is designed in such a manner that water is drained efficiently to prevent swelling of the boards, allows for gaps between two adjacent boards in compliance with building codes, and provides a joint with mechanical and resistance properties comparable to conventional tongue and groove boards.

BACKGROUND OF THE INVENTION

The use of tongue and groove panels or boards for building structures like walls, roofs, floors etc. is conventional. These boards are generally made of wood and include plywood, oriented strand boards (OSB), presswood and the like. To ensure a good mechanical joint between the boards, several tongue and groove designs have been developed. A few problems are, however, associated with these boards and resulting board assemblies. For example, the tongue is sometimes broken when inserted in the groove of an adjacent board, thus causing weaker sections in the assembly formed thereof.

Another major concern is swelling. Although the longitudinal sections of the boards are generally sprayed with a conventional sealer, the presence of water, if not removed, will cause irreversible swelling, thus causing deformation and/or irregularities on the surface and weakening the structure of the board assembly. As a result, the mechanical properties are greatly affected. To avoid such problems, a tongue and groove panel structure has been proposed in U.S. Pat. No. 5,182,892 wherein the tongue is slightly longer that the groove, thus creating a small space between two adjacent panels. Further, the tongue is provided with slots at regular intervals to drain any water present on the surface.

The use of splines, also called joints or strips, for joined two boards or panels is a well-known alternative to tongue and groove boards. Typically, all the longitudinal sections of the boards are grooved, and two adjacent boards are joint by inserting one half of a spline in the groove of one panel, and the other half in the groove of the adjacent panel. Generally, no further fastening is required between the panels. Again, for wood panels, the problem of swelling still remains. Further, if a load is applied on only one side of the spline, i.e., on one panel, it will cause the spline to sag and significantly reduce load transfer capacity.

There is therefore a great need to develop a spline having a structure allowing the drainage of water without causing any assembly deformations or weakening. The mechanical properties of a surface made of boards assembled with such splines should be comparable to those of a surface made of conventional tongue and groove boards, otherwise they would be hardly accepted by the industry.

SUMMARY OF THE INVENTION

In accordance with the present invention, there is now provided a spline or strip for joining boards. More specifically, the spline comprises a central concave ridge, preferably U-shaped, extending throughout the length of the spline. The longitudinal section of each panel will abut on each side of the ridge, leaving a space between the boards equal to the width of the ridge, for draining the water. A plurality of recesses or grooves are preferably provided on each side of the ridge on the upper and lower surfaces of the spline, and extend parallel to the ridge throughout the length of the spline. Such recesses are provided to improve the retention of the boards by the spline.

In a preferred embodiment, the spline is provided with a central ridge on its upper and lower surfaces.

Preferably, the spline is made of a thermoplastic material like polyethylene, polypropylene, polyvinyl chloride, nylon, polystyrene, polyurethane and the like. Also included are thermosetting materials like polyesters, vinyl esters, epoxy and the like. Composite materials like wood chips embedded in thermoplastic materials such as those listed above may also be used.

IN THE DRAWINGS

DETAILED DESCRIPTION OF THE INVENTION

Figure 1:
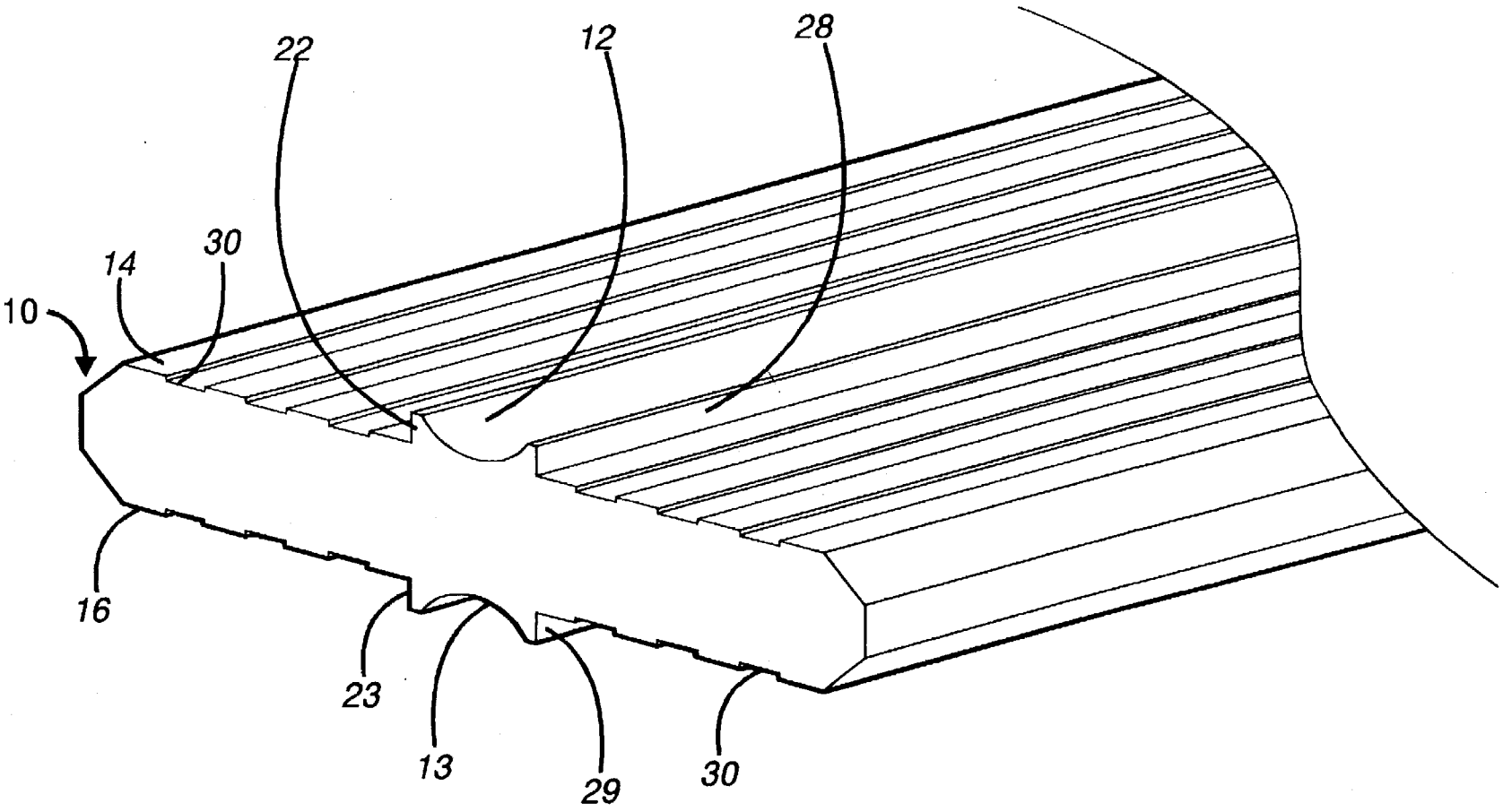
FIG. 1 illustrates a perspective view of the spline of the present invention.
Figure 2:
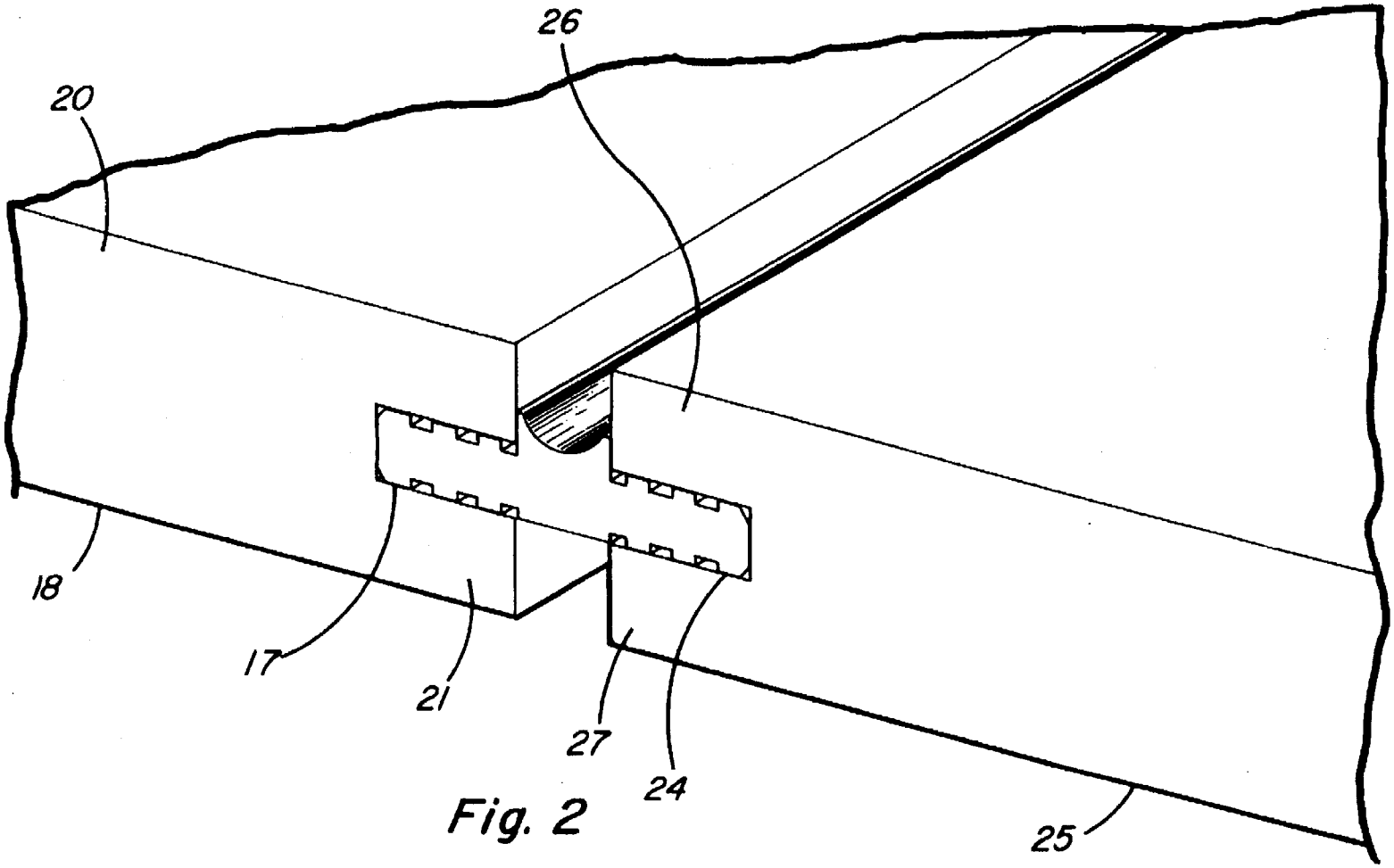
FIG. 2 illustrates the present spline when inserted between two boards and comprising a ridge on only one surface of thereof.

The present spline has been designed to facilitate the drainage of water from surfaces made of boards joined therewith while insuring that mechanical properties remain comparable to those of conventional tongue and groove boards. The development of the present spline also required that it respected the distance between adjacent boards as provided in the building code. Referring to the drawings, there is provided a spline 10 made of a material such as polyethylene, polypropylene, polyvinyl chloride, nylon, polystyrene, polyurethane and the like, comprising U-shaped central ridges 12 and 13 on upper and lower surfaces 14 and 16 respectively, and extending throughout the length of spline 10. Only one of ridges 12 and 13 could be present, as illustrated in FIG. 2 to insure proper spacing between the boards. However, a ridge on each surface is most preferred, especially because if a load is applied on only one side of the spline, i.e., on only one board, it is not possible for the spline to sag because movement of the spline is prevented by the ridges. The direct result is therefore a better load transfer capacity.

Spline 10 is inserted in groove 17 of a first board 18 until the longitudinal protruding sections 20 and 21 of the board abut the sides 22 and 23 of ridges 12 and 13. The other side of spline 10 is then inserted into the longitudinal groove 24 of a second board 25 until its protruding longitudinal section 26 and 27 abut the sides 28 and 29 of ridges 12 and 13. Spline 10 is also provided with a plurality of recesses or grooves 30 to maximize the board retention by the spline.

Figure 3:
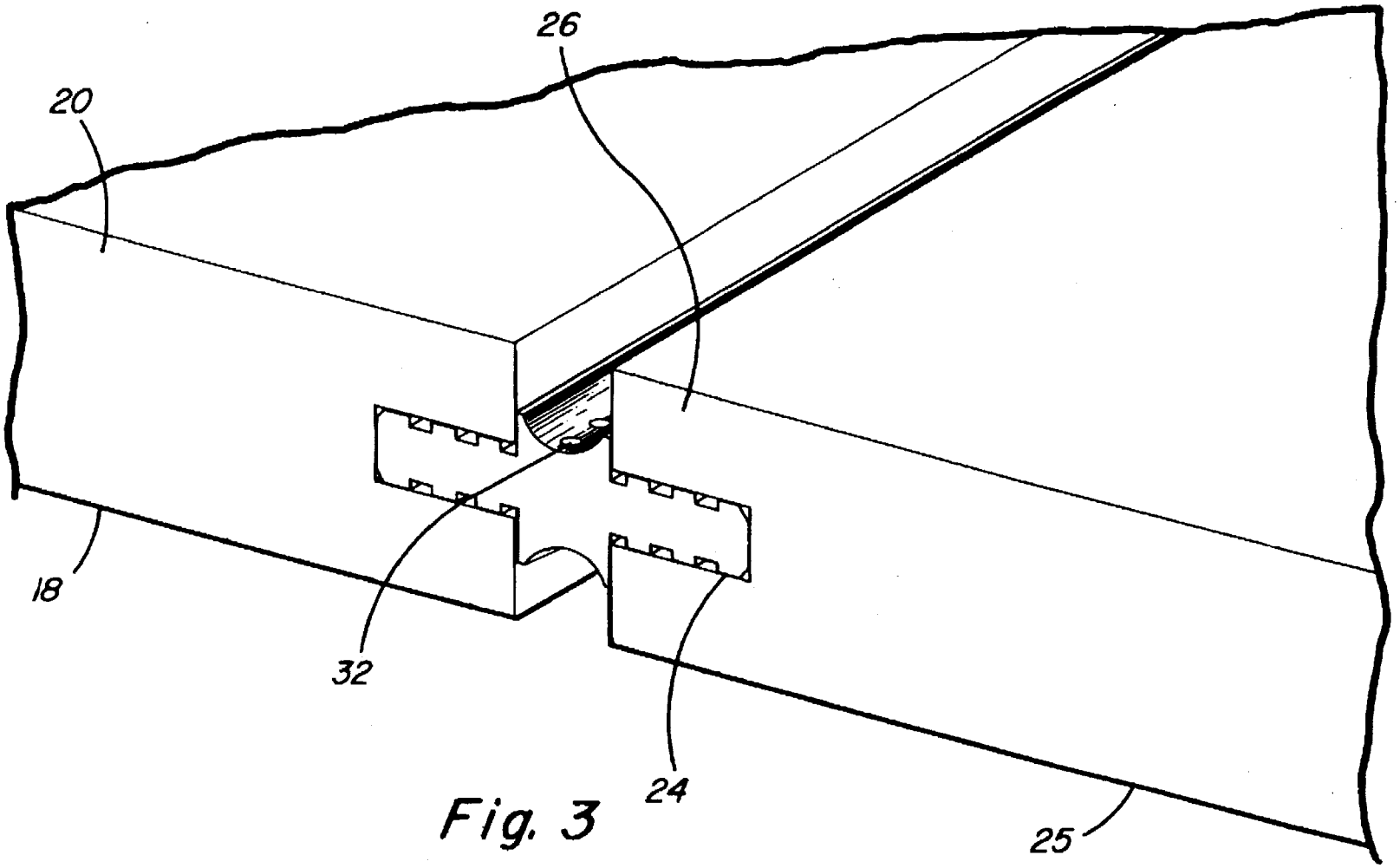
FIG. 3 illustrates a spline as shown in FIG. 1 and comprising a plurality of openings for draining the water.

In the event that the board assembly is substantially flat, holes 32 may be made in spline 10 through ridges 12 and 13, as illustrated in FIG. 3. On the other hand, if there is a slope in the board assembly, for example, in roofing, then such holes are optional since the slope will be sufficient to drain the water away. Preferably, there should be a space or gap between the inner surface of the groove and the spline's end inserted therein to allow linear expansion of the wood.

The stiffness ratio and the average load transfer ratio have been used to compare the properties of conventional 4×8 tongue and groove boards, and 4×8 boards joined with a spline according to the present invention. The stiffness ratio is defined as the ratio of the slopes of the straight portion of the load deflection curves for the continuous portion of the assembled board to the assembled edge, respectively. The average load transfer ratio is calculated by the following equation:

$$\text{load transfer ratio}=1-(\Delta\text{assembled}-\Delta\text{centre})/(\Delta\text{free}-\Delta\text{centre})$$

wherein

Δassembled=deflection of panel under the load point 38 mm from the edge of an assembled tongue and groove;

Δcentre=deflection of panel under the load point in the centre of the half panel; and Δfree=deflection of panel under the load point 38 mm from the edge of the free tongue or groove Experimental results show that the average stiffness ratio for an assembly of boards assembled with the present spline, is 0.768, and that the average load transfer ratio of such assembly is 0.621. In comparison, the average stiffness ratio for conventional tongue and groove boards is 0.805, and the average load transfer ratio is 0.724. The results therefore show that these properties are very similar for either assembly.

The cavity of the ridge is preferably U-shaped, but it could be shaped otherwise, as long as there is a concave shape.

With respect to the size of the spline, preferred dimensions are as follows.

These dimensions are for 4×8 boards having a thickness of ⅝".

width of the spline: 13 mm
width of the ridge: 3 mm
height of the ridge: 0.7 mm
thickness of the spline: 5 mm The above dimensions have been optimized to reduce as much as possible the amount of material required to make the spline. These dimensions could be further modified. For example, the width of the spline could be greater, but since it would require more material, the cost of the spline would increase. The same applies for the width and height of the ridge, i.e., the ridge could be high enough so that its upper portion is flush with the surface of the board. Finally, the thickness of the spline is limited by the thickness of the board. Thinner boards will require thinner splines, and thicker boards will require thicker splines. For example, spline joining ½" thick boards could have a thickness of about 4 mm, while for ¾" thick boards, it could be 6 min.

Since the present spline is made of thermoplastic material or thermosetting material, it can be prepared by any conventional process such as molding or extruding processes, and the like. The spline is typically produced in sections of 4 or 8 feet, but these sections could be longer or shorter, depending on the needs of the end user. Further, the spline does not need to be inserted throughout the whole section of the board as a single piece. For example, an 8 feet section of a board could be filled with 2 splines of 3.5 feet each, or 3 splines of 2.5 feet each, the spaces between the splines further improving water drainage.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A spline for joining two boards or panels provided with a groove extending throughout their longitudinal sections, the spline comprising a body with an upper surface and a lower surface, and a central concave ridge on the upper and lower surfaces for draining water, the ridge extending throughout the length of the spline, so that when two adjacent boards or panels are joined by the spline, the space between the boards or panels is equal to the width of the ridge.

2. A spline according to claim 1 wherein the spline is made of a thermoplastic material or a thermosetting material.

3. A spline according to claim 2 wherein the thermoplastic material is selected from the group consisting of polyethylene, polypropylene, polyvinyl chloride, nylon, polystyrene, polyurethane or combinations thereof, and wherein the thermosetting material is selected from the group consisting of polyesters, vinyl esters, epoxy and combinations thereof.

4. A spline according to claim 1 wherein the ridge is U-shaped.

5. A spline according to claim 1 wherein the spline joins boards or panels are made of wood.

6. A spline for joining two boards or panels provided with a groove extending throughout their longitudinal sections, the spline comprising a body with an upper surface and a lower surface, and a central concave ridge on at least one of the upper or lower surface for draining water, the ridge extending throughout the length of the spline so that when two adjacent boards or panels are joined by the spline, the space between the boards or panels is equal to the width of the ridge, a series of holes being disposed in the ridge.

7. A spline for joining two boards or panels provided with a groove extending throughout their longitudinal sections, the spline comprising a body with an upper surface and a lower surface, and a central concave ridge on at least one of the upper or lower surface for draining water, the ridge extending throughout the length of the spline so that when two adjacent boards or panels are joined by the spline, the space between the boards or panels is equal to the width of the ridge, wherein the upper and lower surfaces each comprise a plurality of recesses extending throughout the length of the spline and parallel to the ridge.

8. A thermoplastic spline for joining two boards or panels of wood provided with a groove extending throughout their longitudinal sections, the spline comprising a body with an upper surface and a lower surface, and a central concave ridge extending throughout the length of the spline on the upper and lower surfaces, the upper and lower surfaces further comprising a plurality of recesses extending throughout the length of the spline and parallel to the ridge, so that when two adjacent boards or panels are joined by the spline, the space between the boards or panels is equal to the width of the ridge.

9. A spline according to claim 8 further comprising a series of holes in the ridges.

10. A spline according to claim 8 made of a material selected from the group consisting of polyethylene, polypropylene, polyvinyl chloride, nylon, polystyrene, polyurethane, polyesters, vinyl esters, epoxy or combinations thereof.

* * * * *